United States Patent [19]

Kulesza

[11] 4,271,744

[45] Jun. 9, 1981

[54] MUSICAL TOY

[75] Inventor: Ralph J. Kulesza, Chicago, Ill.

[73] Assignee: Marvin Glass & Associates, Chicago, Ill.

[21] Appl. No.: 82,651

[22] Filed: Oct. 9, 1979

[51] Int. Cl.[3] ..... G10D 7/02

[52] U.S. Cl. ..... 84/330; 46/44; 46/118; 84/476

[58] Field of Search ..... 46/44, 118, 178–180; 84/83, 330, 375, 476

[56] References Cited

U.S. PATENT DOCUMENTS

| | | | |
|---|---|---|---|
| 400,123 | 3/1889 | Schoenner | 46/179 X |
| 3,282,144 | 11/1966 | Knott | 84/375 |
| 4,114,501 | 9/1978 | Tanaka | 84/330 |

FOREIGN PATENT DOCUMENTS

| | | | |
|---|---|---|---|
| 658322 | 10/1951 | United Kingdom | 84/330 |

*Primary Examiner*—Lawrence R. Franklin

*Attorney, Agent, or Firm*—Mason, Kolehmainen, Rathburn & Wyss

[57] ABSTRACT

A musical toy includes a bellows for creating a flow of air and an air tube connecting the bellows to a musical instrument such as a harmonica or a plurality of whistles. The musical instrument is selectively moved relative to the outlet of the air tube to create a pattern of different tones or sounds. A rack mounted on the musical instrument is in engagement with and moved by a circular gear rotatably mounted on the toy. The toy further includes means for compressing the bellows and a handle for rotating the circular gear.

7 Claims, 3 Drawing Figures

MUSICAL TOY

BACKGROUND OF THE INVENTION

1. Field of the Invention

The device of the present invention relates to a sounding toy and in particular to a new and improved musical toy.

2. Description of the Prior Art

It is desirable that in toys intended to be used by younger children that they include sound and action in the toy, for such a toy attracts a child's attention and provides long periods of entertainment. A sound-producing toy, however, should preferably produce more than one sound since only one action or sound can rapidly become monotonous to the child. Accordingly, it is desirable to provide a musical toy capable of producing a plurality of tones or series of tones in a pattern in response to action performed by a child.

SUMMARY OF THE INVENTION

An object of the present invention is to provide a new and improved musical toy.

Another object of the present invention is to provide a new and improved musical toy that provides a plurality of tones or sounds.

A further object of the present invention is to provide a new and improved musical toy that combines action and sound in the same toy.

Still another object of the present invention is to provide a new and improved musical toy that requires action by the user to create musical tones as well as further action by the user to provide a variety or pattern of musical tones.

The present invention is directed to a new and improved musical toy including a bellows for creating a source of pressurized air upon compression of the bellows. A tube provides fluid communication between the bellows and a musical instrument which includes a plurality of whistles or a harmonica. The musical toy of the present invention includes a rack, defined on the musical instrument and a circular gear rotatably mounted in the toy meshing with the rack. The circular gear may be selectively rotated so as to vary the position of the musical instrument relative to the tube to produce a pattern of tones.

BRIEF DESCRIPTION OF THE DRAWINGS

The above and other objects and advantages and novel features of the present invention will become apparent from the following detailed description of the preferred embodiment illustrated in the accompanying drawing wherein.

DESCRIPTION OF THE PREFERRED EMBODIMENT

Figure 1:
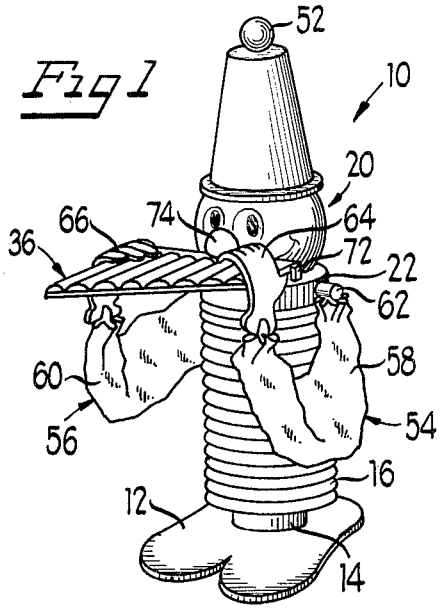
FIG. 1 is a perspective view of a toy constructed in accordance with the principles of the present invention.

Having reference now to the drawing and initially to FIG. 1, there is illustrated a musical toy generally designated by the reference numeral 10. The toy 10 is of the type capable of producing a variety of musical notes in response to manipulation of the toy 10 by a child or other user. The toy 10 as illustrated in the preferred embodiment is fabricated in the form and shape of a clown, however, it is not intended to limit the toy to this configuration.

The toy 10 is mounted on a base 12 that in accordance with the clown theme of the toy 10 is in the configuration of a pair of shoes or feet. The base 12 includes an upstanding circular flange 14 within which is positioned the lower end of a compressible bellows 16. The toy 10 also includes an upper portion generally designated by the reference numeral 20 that is in the shape of a clown's head. The upper portion 20 includes a depending flange 22 within which the top of the bellows 16 is inserted.

As can be understood, by grasping the head 20 of the toy 10 and pushing downwardly toward the base 12, the bellows 16 is compressed. The air compressed within the bellows 16 flows through an aperture 24 defined in the top of the bellows 16. An angular hollow air tube 26 extends through an aperture 28 into the head top portion 20 and terminates at the approximate location of the mouth of the clown figure of the toy 10.

Figure 2:
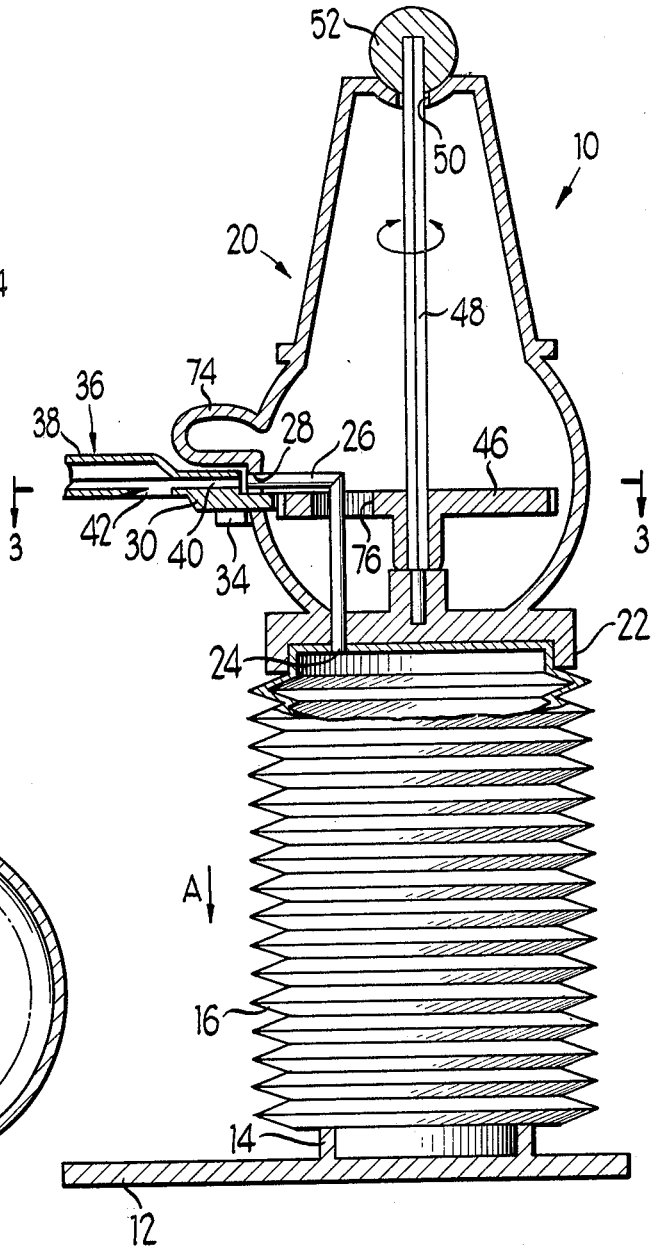
FIG. 2 is an enlarged vertical cross-sectional view of the toy.

A rack 30 including a plurality of teeth 32 is also slideably mounted in the aperture 28 and positioned on top of a forwardly extending lip 34 that supports the rack 30. A musical instrument generally designated by the reference numeral 36 is secured to the rack 30. In the preferred embodiment illustrated the instrument 36 includes a plurality of slotted tubes or whistles 38 such as in a harmonica. Each tube includes an opening 40 and a bottom slot 42 as shown in FIG. 2. As best illustrated in FIG. 2, when the opening 40 is positioned adjacent to the end of the air tube 26 and the bellows 16 is compressed, air is forced through the opening 40 and out the slot 42 producing a tone or whistling sound.

Figure 3:
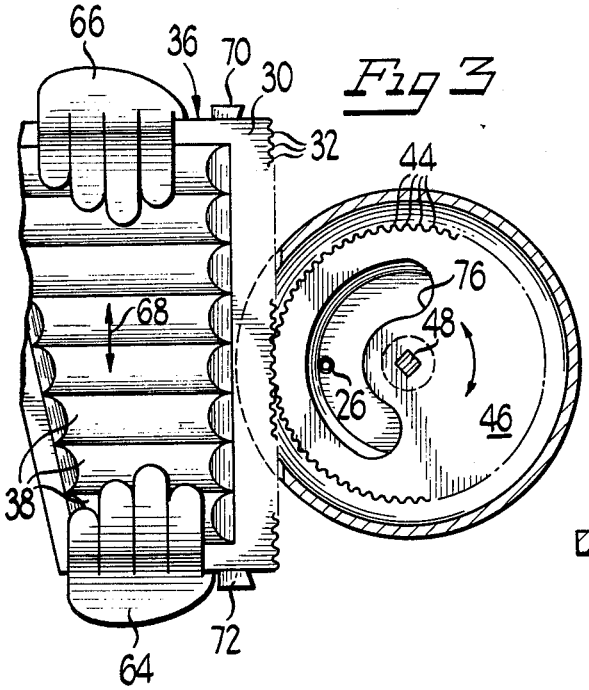
FIG. 3 is a view taken along line 3—3 of FIG. 2.

The teeth 32 of the rack 30 are held in meshing engagement with teeth 44 of a horizontal circular gear 46 (FIG. 3) mounted within the upper portion 20 of the toy. The gear 46 is rotatably mounted by a vertical shaft 48 positioned within the head portion 20 of the toy 10. The shaft 48 includes a first end that is rotatably mounted in the flange 22 and a second end that extends through an aperture 50 in the upper end of the top portion 20. A ball 52 or similar device that is easily grasped is secured to the upper level of the shaft 48.

To add realistic characteristics to the toy 10, flexible arms generally designated by the reference numerals 54 and 56 may be included. The arms 54 and 56 are defined by ribbons of cloth or other material 58 and 60 secured between pins 62 integrally defined on the flange 22 and two molded hands 64 and 66 that are secured to the musical instrument 36.

To operate the toy 10, the child grasps the head or upper portion 20 and pushes downwardly in the direction of arrow A compressing the bellows 16 and forcing air through the air tube 26 and through one of the whistles 38 creating a tone. At the same time, the child may rotate the ball 52 thereby rotating the shaft 48 and the circular gear 46. Through the engagement of the teeth 44 of the circular gear 46 with the teeth 32 of the rack 30, the rack 30 is moved in a direction of the arrow 68 (FIG. 3) alternately positioning a different whistle 38 adjacent the air tube 26.

During the operation of the toy 10, it is desirable to prevent the rack 30 from sliding out of the sides of the shelf 34 and this is accomplished by the provision of stops 70 and 72 at the opposite ends of the rack 30 that engage an abutment in the shape of a nose 74 defined on the toy 10. In addition, the circular gear 46 includes a banana slot 76 through which the air tube 26 extends to allow rotation of the gear 46 without interference with the air tube 26.

Many modifications and variations of the present invention are possible in light of the above teachings. Thus, it is to be understood that, within the scope of the appended claims, the invention may be practiced other than as specifically described above.

What is claimed and desired to be secured by Letters Patent of the United States is:

1. A musical toy comprising:

a housing in the shape of a figure including a head with a mouth opening;

a fluid pump in said housing for pressurizing a fluid;

means for conveying said pressurized fluid from said pump to said mouth opening;

a musical wind instrument slidably mounted for reciprocation relative to said mouth opening, having a plurality of side by side tone producing mechanisms of different pitch each positionable in fluid communication with said mouth opening; and a control means for selectively reciprocating said instrument relative to said mouth opening to align different mechanisms with said mouth opening.

2. The toy of claim 1 including flexible arms attached to said housing on one end and to said instrument on the other end.

3. The toy of claim 1 wherein said control means includes a rotatable portion operatively connected to said instrument for moving said instrument relative to said mouth opening by rotation thereof.

4. The toy of claim 3 wherein said instrument includes a rack gear, and said rotatable portion includes a pinion mating with said rack gear.

5. The toy of claim 3, wherein said fluid pump is a compressible chamber including a tube communicating between said mouth opening and the interior of said chamber.

6. The toy of claims 1 or 5 wherein said control means and said fluid pump are operable with one hand.

7. The toy of claim 3 wherein said rotatable portion is mounted on the top of the head to provide a grasping means for moving said instrument and operating said fluid pump.

* * * * *